US006200423B1

(12) United States Patent
Georger et al.

(10) Patent No.: US 6,200,423 B1
(45) Date of Patent: Mar. 13, 2001

(54) METHOD OF CONTROLLING BASIS WEIGHT PROFILE USING MULTI-LAYER CONSISTENCY DILUTION

(75) Inventors: Jill Anderson Georger, Neenah; Robert Thomas VanDen Heuvel, Appleton; Christopher John Lawler, Neenah, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/442,616

(22) Filed: Nov. 18, 1999

(51) Int. Cl.[7] ..... D21F 11/00

(52) U.S. Cl. ..... 162/198; 162/198; 162/DIG. 10; 162/DIG. 11; 162/252; 162/258; 162/259; 162/263; 162/343

(58) Field of Search ..... 162/DIG. 10, DIG. 11, 162/198, 252, 258, 259, 263, 343

(56) References Cited

U.S. PATENT DOCUMENTS 4,767,935 * 8/1988 Anderson et al. ..... 250/571
5,609,726 * 3/1997 Sollinger ..... 162/125
5,688,374 * 11/1997 Begemann et al. ..... 162/343
6,030,500 * 2/2000 Haraldsson et al. ..... 162/343

* cited by examiner

*Primary Examiner*—Stanley S. Silverman
*Assistant Examiner*—Mark Halpern
(74) *Attorney, Agent, or Firm*—Gregory E. Croft

(57) ABSTRACT

The stock approach piping to a multi-layered headbox can be modified to include a dilution water header that independently supplies dilution water, such as whitewater, to multiple CD segments or zones of the tube bank which supply stock to each layer. The CD basis weight profile of the final sheet is monitored and, in response to the measured CD profile, dilution water flow is increased or decreased to those tube bank segments that need their consistency altered. By selectively controlling the basis weight of distinct segments of the CD profile for each layer, a more uniform sheet can be produced.

10 Claims, 4 Drawing Sheets

METHOD OF CONTROLLING BASIS WEIGHT PROFILE USING MULTI-LAYER CONSISTENCY DILUTION

BACKGROUND OF THE INVENTION

In the manufacture of paper webs, such as tissues, towels, wipers, and fine paper, it is necessary to carefully control the cross-machine direction (CD) formation of the sheet in order to maintain the desired uniformity and properties of the final product. For products consisting of a single layer of fibers, the control of the CD profile has been proven in prior art. However, for multi-layered products in which a layered headbox is used to simultaneously deposit multiple layers of different fibers into the forming zone, merely controlling the overall CD basis weight profile through control of a single layer or equal control of all layers is not adequate, since even when the overall CD profile is uniform, there may be off-setting irregularities within each of the layers that have a significant impact on the final sheet properties. For tissue papers, these properties include, but are not limited to, tensile strength, layer purity, opacity and hand feel.

Therefore, in order to ensure that good sheet properties are consistently obtained when making multi-layered sheets, there is a need for a method of independently controlling the CD basis weight profile of individual layers of fibers within the sheet.

SUMMARY OF THE INVENTION

It has now been discovered that the stock approach piping to a multi-layered headbox can be modified to include a dilution water header that independently supplies dilution water, such as whitewater, to multiple CD segments or zones of the approach to the headbox or the tube bank of the headbox nozzle which supplies stock to each layer. The CD basis weight profile of the final sheet is monitored and, in response to the measured CD profile, dilution water flow is increased or decreased to those tube bank segments that need their consistency altered. By selectively controlling the basis weight of distinct segments of the CD profile for each layer, a more uniform sheet can be produced.

Hence in one aspect, the invention resides in a method of controlling the CD basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction basis weight profile of one or more of the layers in the web or the dried sheet; and (d) in response to the measurement of the cross-machine direction basis weight profile, providing dilution water to selected tube bank tubes to locally adjust the basis weight of that layer. As used herein, "fibers" can include cellulosic or synthetic fibers.

More specifically, the invention resides in a method of controlling the CD basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction overall basis weight profile of the web or dried sheet;

(d) measuring the cross-machine direction basis weight profile of one or more of the layers in the web or the dried sheet; and (e) in response to the measurement of the overall cross-machine direction basis weight profile and the cross-machine direction basis weight profile of said one or more layers, providing dilution water to selected tube bank tubes to locally adjust the basis weight of that layer.

In another aspect, the invention resides in a method of controlling the CD basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction profile of at least one basis weight-related property, such as tensile strength, opacity, or layer purity, of one or more of the layers in the web or the dried sheet; and (d) in response to the measurement of the basis weight-related property profile, providing dilution water to selected tube bank tubes to locally adjust the basis weight of one or more layers.

In another aspect, the invention resides in a method of controlling the CD basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction basis weight profile of one or more of the layers in the web or the dried sheet;

(d) measuring the cross-machine direction overall basis weight profile of web or dried sheet;

(e) measuring the cross-machine direction profile of a basis weight-related sheet property, such as tensile strength, opacity, or layer purity, of one or more of the layers in the web or the dried sheet; and (f) in response to the measurement of the cross-machine direction overall basis weight profile and the cross-machine direction layer basis weight profile or a basis weight-related sheet property, providing or eliminating dilution water to selected tube bank tubes to locally adjust the basis weight of that layer.

The number or frequency of the stock tubes which are controllably fed by dilution tubes in the cross-machine direction of the headbox can vary with the application. Depending upon the frequency and arrangement of the stock tubes, it may or may not be desirable to have one dilution tube for every stock tube. The purpose is to be able to adequately modify the local basis weight of the layer in question sufficiently to reach the desired target basis weight. This will depend on the degree of variability that is acceptable for the given product, the speed of the machine, the flow rates within the tubes, the number of tubes, etc. In general, however, from about 1 to about 24 dilution tubes per foot of cross-machine deckle are believed to be suitable.

The means for determining if a dilution adjustment is needed can be any means that directly or indirectly measures the profile of the cross-machine direction basis weight, or a related property, for one or more layers. The measurement can be made on the wet web or the dry sheet. It can also be made on-line or off-line. While on-line measurements can be preferred because of their fast responsiveness, off-line measurements are also useful because many of the cross-machine irregularities remain relatively constant over long periods of time if the paper making process is adequately stabilized or controlled. Therefore, the fast response of on-line measurements is not always necessary. Suitable measurement techniques include, without limitation, the following:

(a) Infrared spectroscopy. This technique can detect different absorption wavelengths for different fiber types. Infrared spectroscopy can also be used to detect the presence of chemical additives or fiber structural changes due to mechanical treatment of the pulp, or other pulp characteristics. For instance, when using near infrared spectroscopy, analysis of the 2nd derivative of the absorption spectra may be used to differentiate hardwood from softwood pulps. Also, infrared spectral differences may be employed using specular reflectance. Traditional off-line absorption spectroscopy in the 800–900 cm-1 regions can be used as well. Both methods are readily available off-line.

(b) Addition of a chemical trace. Commonly used chemical additives, such as wet strength additives or dry strength additives, can be detected using known analytical techniques. Also, a new chemical additive can be added for the sole purpose of measuring its presence, such as adding an optical brightener, which can be detected using ultraviolet technology.

(c) Measuring opacity. An on-line or off-line technique where the opacity of the paper is measured using a suitable sensor. The opacity of the sheet can be measured in several cross machine sections corresponding to the dilution zones. A low opacity would prompt removal of dilution water to increase the basis weight of a selective layer.

(d) Image analysis. This technique can be used to detect different physical fiber characteristics, which could be natural characteristics or characteristics imparted by mechanical pretreatment. The identification of certain fiber types would indicate the ratio of the fibers present from given layers of the sheet. This information in combination with basis weight data would be used to manipulate the dilution in a specific layer to control weight while maintaining desired properties. This could be an on-line or off-line measurement.

(e) Image spectroscopy. This technique could include the manipulation of vibrational spectroscopy with a camera to measure fiber density changes. Different fiber types may be denser than others. This information in combination with basis weight data would be used to manipulate the dilution in a specific layer to control weight while maintaining desired properties. This could be an on-line or off-line measurement.

(f) Measuring tensile strength. This would be an off-line test. A full cross machine direction sample would be cut into smaller widths depending on the frequency of the dilution addition to the headbox. The tensile strength of each section would be measured and evaluated with the basis weight of the same segments to determine where the basis weight discrepancy is present. For example, if there is a strength deficiency in the same segment, there could be a deficiency of fiber in the strength bearing layer and the dilution profile would be changed appropriately.

(g) Measuring layer purity. This is also an off-line test. Tape pulls in the direction of the cross machine direction paper segments would be tested. The count of fibers in each layer is made using the structure of the fiber as the distinguishing factor. This information in combination with basis weight data would be used to manipulate the dilution in a specific layer to control weight while maintaining desired properties.

There may be other means of measuring these and other paper web qualities that may prove to be useful in enhancing the quality of tissue products.

DETAILED DESCRIPTION OF THE DRAWINGS

Figure 1:
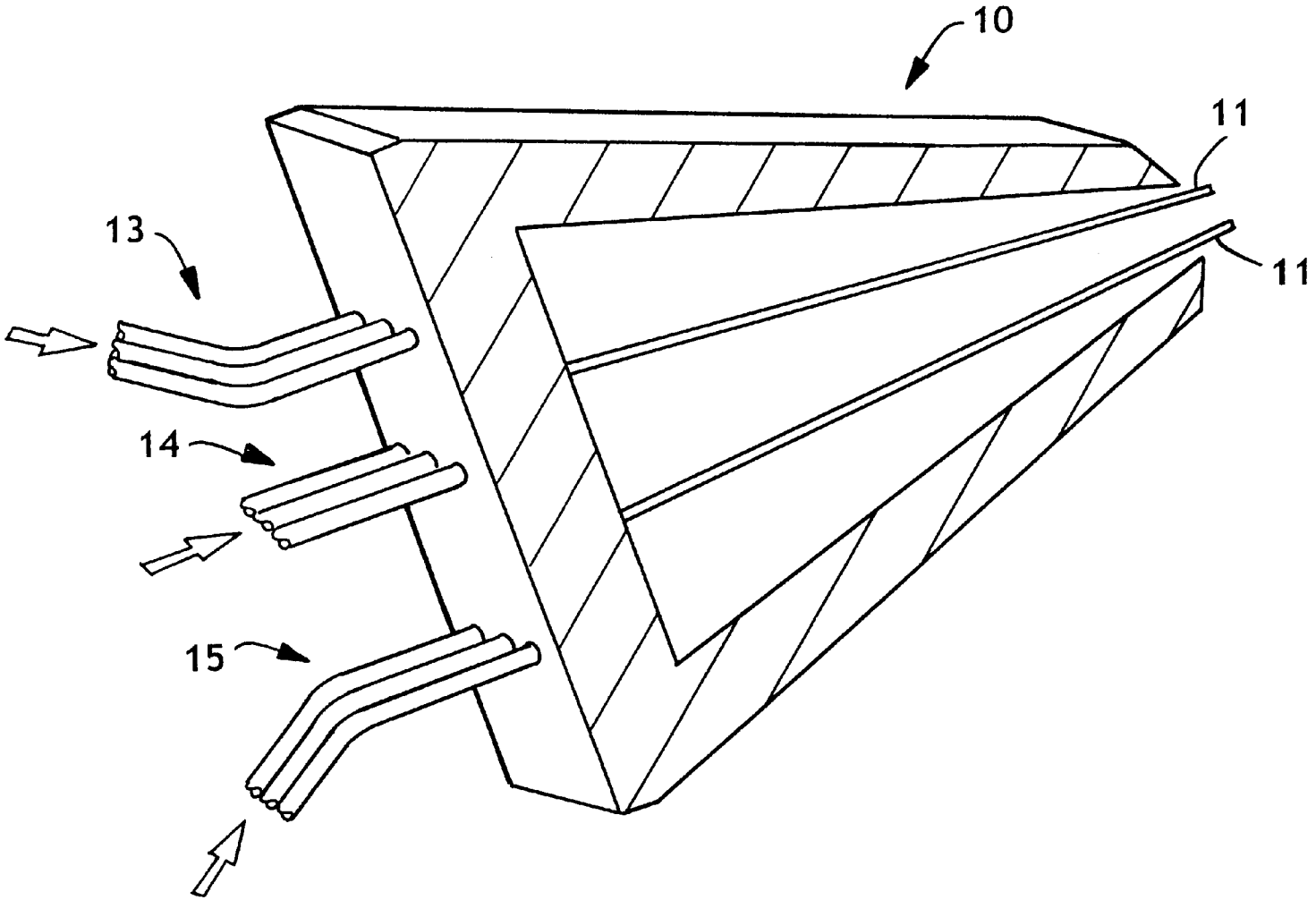
FIG. 1 is a schematic view of a segment of a layered headbox, illustrating how each individual layer is fed by the stock tubes of the tube bank.

Referring to FIG. 1, the invention will be described in greater detail. Shown in FIG. 1 is a schematic representation of a cross-section of a layered headbox 10, viewed in the cross-machine direction, having three layering channels (A, B and C). Each layering channel is separated by a divider 11 that maintains the layered furnishes separate as they leave the headbox. Each layering channel is supplied from a distribution header with a separate furnish by its own bank of stock tubes 13, 14 and 15, respectively.

Figure 2:
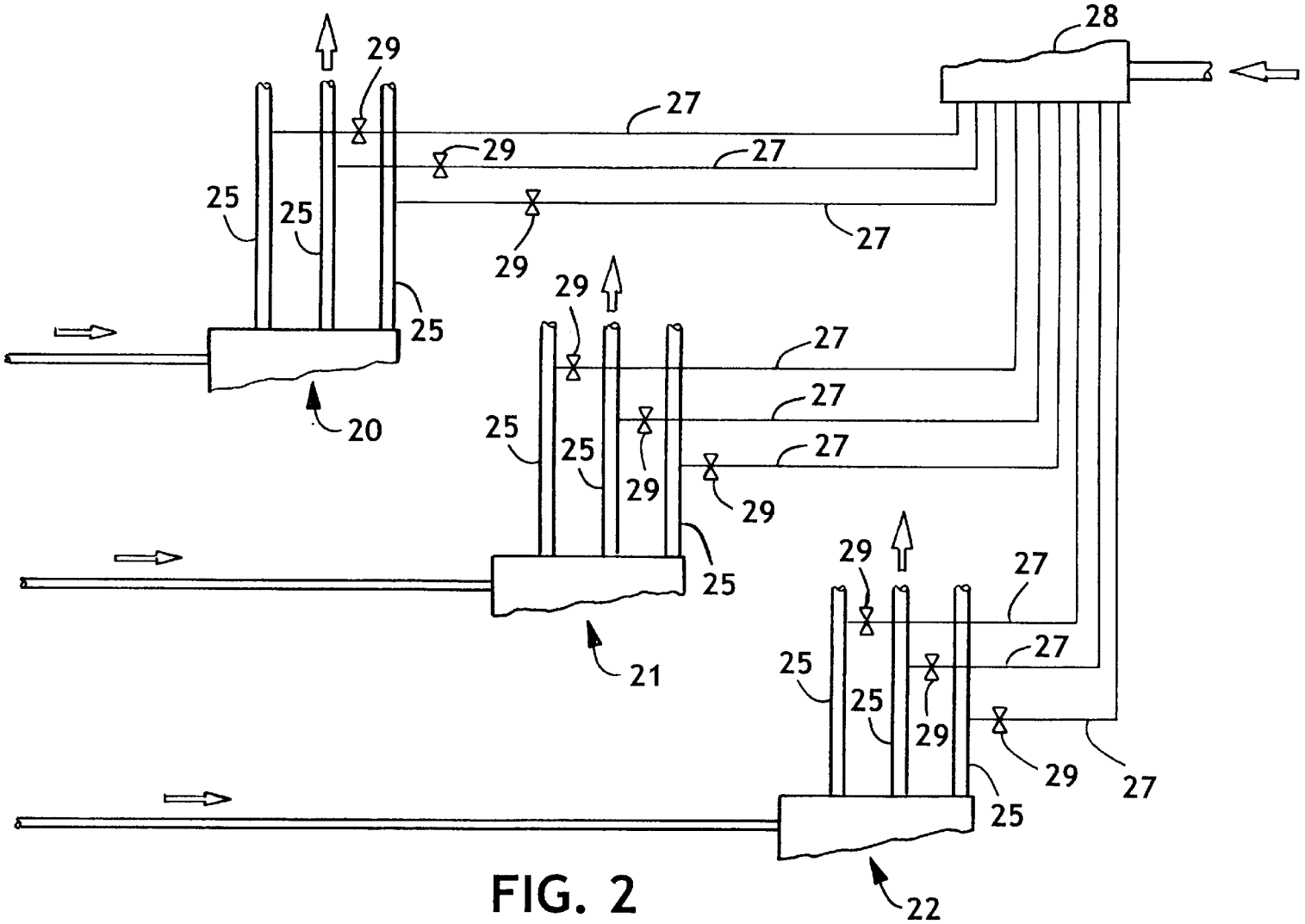
FIG. 2 is a schematic flow diagram of the stock system approach piping, illustrating how the dilution tubes feed into the stock tubes.

FIG. 2 is a schematic representation of the stock system approach piping that feeds stock to the various layering channels of the headbox. As shown, for each layering channel, stock and white water from the fan pump are fed to distribution headers 20, 21 and 22, respectively, each of which splits the flow into multiple stock tubes 25 that feed one of the headbox layering channels. The number of layering channels can be from two to eight. It is not necessary that each layering channel contain a different furnish, although at least two of the channels must have a different furnish in order to provide a layered product. Preferably, tied into each stock tube 25 is a dilution tube 27 that controllably provides dilution water from a dilution header 28, preferably recirculated white water, to the stock flow. A control valve 29 in each line allows the dilution water flow rate to be controlled in response to a downstream property measurement as discussed above. In order to have the ability to locally increase or decrease the basis weight, there must be a sufficient amount of dilution water flowing through the dilution tubes at all times. In general, the amount of dilution water normally supplied is about 10 percent of the total amount of water in the aqueous fiber suspension supplied to the headbox.

In operation, the total basis weight of the tissue web is measured for each cross-machine direction zone after the papermaking machine is operating at a steady state. The basis weight profile can be measured using an on-line scanning device, which is commercially available from several vendors, or it can be done off-line in a laboratory. As illustrated in FIGS. 3A–3F (which will be discussed below), after the overall basis weight of the web is measured, the sheet can be separated into individual layers using a conventional "tape pull" test and the furnish ratio can be determined for each layer. From the furnish ratio measurement it can be determined which cross-machine direction zones need to have the basis weight adjusted and in which layer the adjustment needs to be done. In addition, as illustrated in FIGS. 4A–4H (also discussed below), the tensile strength cross-machine direction profile of the sheet often can be correlated with the profile of a single layer, especially if the layer contains a furnish providing considerable strength. The tensile strength can be measured in the lab to determine which cross-machine direction zones need to have the strength furnish layer(s) adjusted. Any of the measurement techniques previously described above could be used for this step.

Figure 3:
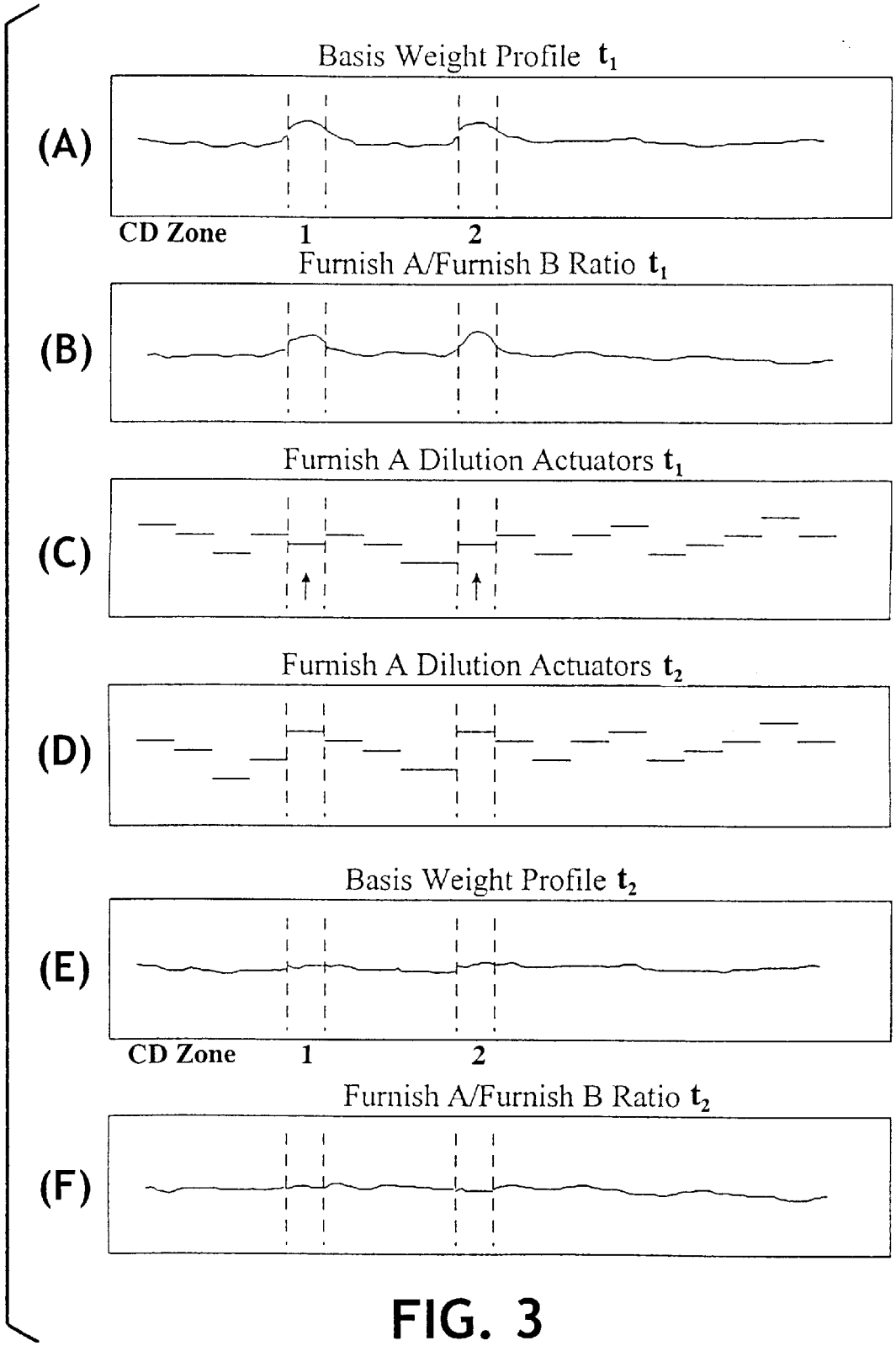
FIG. 3A is a typical cross-directional basis weight profile graph of a multi-layered paper web, illustrating the variability in the basis weight across the deckle of the sheet.
FIG. 3B is a similar graph on the same cross-machine direction scale, illustrating the measured basis weight ratio for 2 layers of the multi-layered sheet, the furnish of layer A and the furnish of layer B.
FIG. 3C is a schematic representation of the position of the dilution actuators (control valves) controlling the dilution water flowing to the stock tubes for layer A at the time ($t_1$) that the conditions graphed in FIGS. 3A and 3B existed. (A higher position of the actuator correlates with a higher dilution water flow rate.)
FIG. 3D is a schematic representation of the position of the dilution actuators for layer A at a later time ($t_2$) after the flow of dilution water has been locally adjusted.
FIG. 3E is a graph of the overall basis weight profile for the tissue after the consistency dilution has been adjusted as described in FIG. 3D.
FIG. 3F is a graph of the basis weight ratio for the furnish of layer A and the furnish of layer B after the consistency dilution has been adjusted.

Turning now to FIGS. 3A–3F, an example of a control strategy for a particular paper web is illustrated in which the web formation is controlled using the measurement of layer basis weights. As shown in FIG. 3A, the basis weight in cross-machine direction (CD) zones 1 & 2 is higher than the basis weight setpoint, and the furnish ratio measurements (FIG. 3B) show that the furnish from layer A is a higher weight percentage of the tissue web than the other layers in these same two zones. Accordingly, the consistency dilution water in layer A would be increased proportionately to adjust (lower) the layer A weight percentage. Accordingly, the dilution actuators in CD zones 1 and 2 would have to be opened, which is illustrated in FIGS. 3C and 3D by moving the position of the dilution actuator in the upward direction. The consistency dilution in the other layers may also have to be changed (not shown) to obtain the desired weight percentage in each layer. The resulting basis weight and furnish ratio profiles after the appropriate dilution water corrections are illustrated in FIGS. 3E and 3F.

Figure 4:
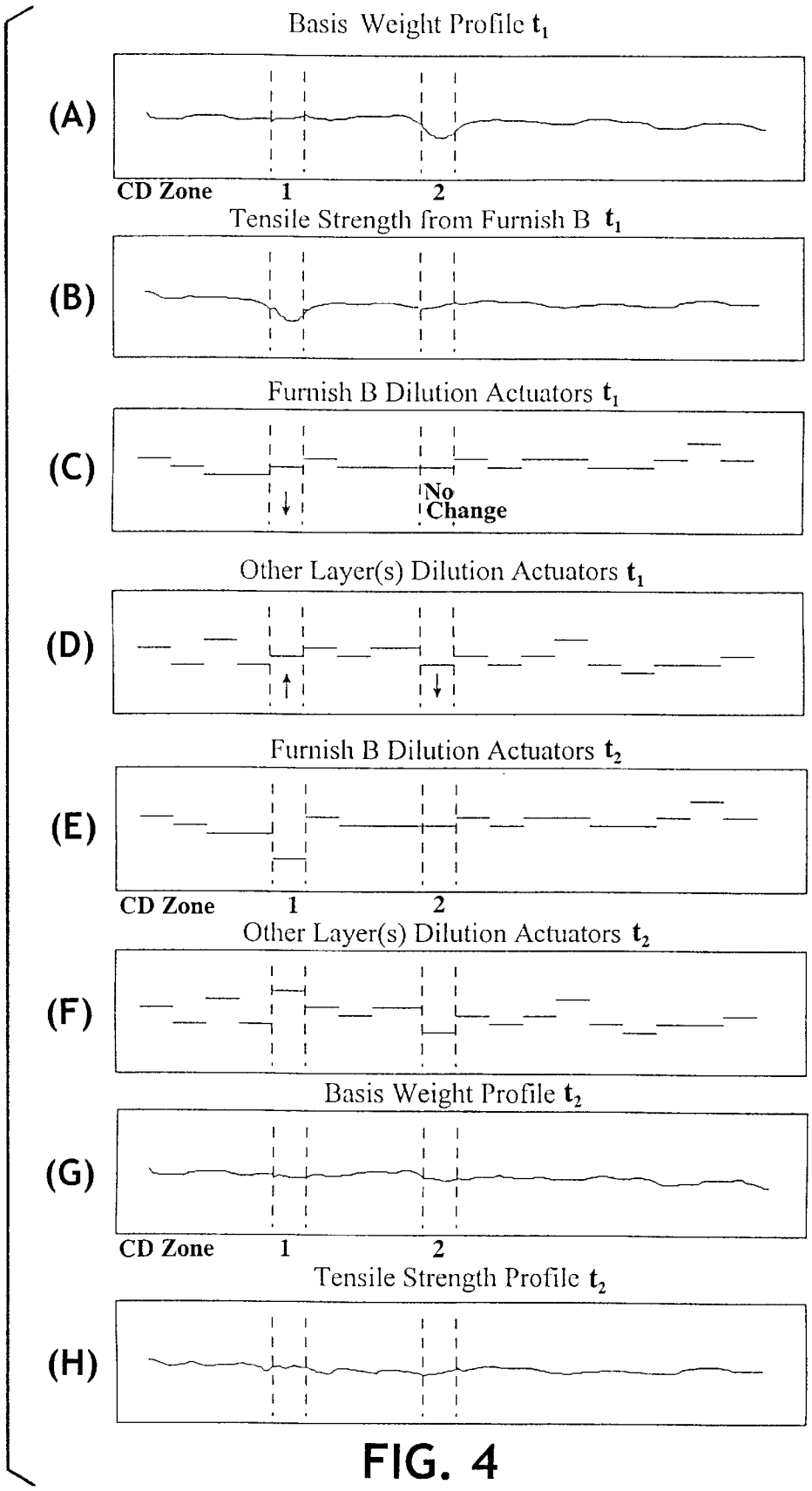
FIG. 4A is another graph of the overall cross-directional basis weight profile for a typical paper web, similar to the graph of FIG. 3A.
FIG. 4B is a graph showing the cross-directional tensile strength profile of the paper web attributable to the furnish of layer B.
FIG. 4C is a schematic representation of the position of the dilution actuators for furnish B at the time ($t_1$) the graphs of FIGS. 4A and 4B were made.
FIG. 4D is a schematic representation of the position of the dilution actuators for furnish A at the time ($t_1$) the graphs of FIGS. 4A and 4B were made.
FIG. 4E is a schematic representation of the position of the dilution actuators for furnish B at a later time ($t_2$) after the dilution rate has been locally adjusted.
FIG. 4F is a schematic representation of the position of the dilution actuators for furnish A at a later time ($t_2$) after the dilution rate has been locally adjusted.
FIG. 4G is a graph of the corrected overall basis weight profile at time $t_2$.
FIG. 4H is a graph of the corrected overall tensile strength profile at time $t_2$.

FIG. 4 illustrates a different example in which formation of a multi-layered web is controlled using the measurement of tensile strength. In this case, the overall basis weight in CD zone 1 is at the basis weight set point or target (FIG. 4A), but the tensile strength measurement in CD zone 1 shows that the tensile strength is too low (FIG. 4B). Because in this case it is known that the tensile strength quality comes substantially from the furnish in layer B, the consistency dilution water in CD zone 1 of layer B could be decreased proportionately (FIGS. 4C and 4E) to increase the basis weight of layer B in CD zone 1 and thereby increase the layer B tensile strength in that zone. The consistency dilution in the other layer(s) will then have to be increased to lower their respective basis weights in CD zone 1 to compensate and maintain the overall basis weight in CD zone 1 at the target level (FIGS. 4D and 4F).

On the other hand, regarding CD zone 2, because the overall basis weight profile in CD zone 2 is also low (FIG. 4A) and the tensile strength is at target (FIG. 4B), no change to the dilution water of layer B is necessary (FIGS. 4C and 4E). However, in order to increase the overall basis weight profile in CD zone 2 back up to the target level, one or both of the other layers will require an adjustment (decrease) of the dilution water (FIGS. 4D and 4F).

By making similar changes in the other CD zones, the overall basis weight profile (FIG. 4G) and the tensile strength profile (FIG. 4H) can be brought to target levels.

It will be appreciated that the foregoing illustrations are not to be considered as limiting the scope of this invention, which is defined by the following claims and all equivalents thereto.

We claim:

1. A method of controlling the cross-machine direction (CD) basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction basis weight profile of each of the layers in the web or the dried sheet; and (d) in response to the measurement of the cross-machine direction basis weight profile, increasing or decreasing the dilution water to selected tube bank tubes to locally adjust the basis weight of each layer.

2. The method of claim 1 wherein the cross-machine direction basis weight profile is measured on-line.

3. The method of claim 2 wherein the cross-machine direction basis weight profile is measured using infrared spectroscopy.

4. The method of claim 1 wherein the cross-machine direction basis weight profile is measured off-line.

5. The method of claim 4 wherein the cross-machine direction basis weight profile is measured using a tape-pulls to count fibers in each layer.

6. A method of controlling the CD basis weight profile of a layered paper web comprising:

(a) forming a layered paper web by using a layered headbox to deposit into a forming zone two or more aqueous suspensions of fibers, each of which corresponds to a different layering channel within the layered headbox;

(b) providing each layering channel with an aqueous suspension of fibers through a tube bank comprising a multiplicity of tubes arranged in the cross-machine direction of the headbox;

(c) measuring the cross-machine direction overall basis weight profile of the web or dried sheet;

(d) measuring the cross-machine direction basis weight profile of each of the layers in the web or the dried sheet; and (e) in response to the measurement of the overall cross-machine direction basis weight profile and the cross-machine direction basis weight profile of each of said layers, increasing or decreasing dilution water to selected tub banks tubes to locally adjust the basis weight of each layer.

7. The method of claim 6 wherein the cross-machine direction basis weight profile of one or more layers is measured on-line.

8. The method of claim 7 wherein the cross-machine direction basis weight profile of one or more layers is measured using infrared spectroscopy.

9. The method of claim 6 wherein the cross-machine direction basis weight profile of one or more layers is measured off-line.

10. The method of claim 9 wherein the cross-machine direction basis weight profile is measured using a tape-pulls to count fibers in each layer.

* * * * *